US009033551B2

(12) United States Patent
Han et al.

(10) Patent No.: US 9,033,551 B2
(45) Date of Patent: May 19, 2015

(54) LIGHT EMITTING DIODE LAMP

(75) Inventors: Jang-Min Han, Nonsan-si (KR); Kyeong-Jun Lim, Daejeon (KR)

(73) Assignees: Global and Creative Partnership, Daejeon (KR); People & Give Co., Ltd., Daejeon (KR)

( * ) Notice: Subject to any disclaimer, the term of this patent is extended or adjusted under 35 U.S.C. 154(b) by 0 days.

(21) Appl. No.: 13/637,820

(22) PCT Filed: May 18, 2012

(86) PCT No.: PCT/KR2012/003969

§ 371 (c)(1),
(2), (4) Date: Dec. 11, 2012

(87) PCT Pub. No.: WO2013/118946

PCT Pub. Date: Aug. 15, 2013

(65) Prior Publication Data

US 2014/0340906 A1 Nov. 20, 2014

(30) Foreign Application Priority Data

Mar. 10, 2012 (KR) ..... 10-2012-0013802

(51) Int. Cl.

| | |
|---|---|
| ***F21V 29/00*** | (2006.01) |
| ***F21K 99/00*** | (2010.01) |
| ***F21V 31/04*** | (2006.01) |
| ***F21V 15/01*** | (2006.01) |
| ***F21V 23/02*** | (2006.01) |
| ***F21V 3/02*** | (2006.01) |
| *F21Y 101/02* | (2006.01) |
| *F21V 7/22* | (2006.01) |
| *F21V 3/00* | (2006.01) |
| *F21V 3/04* | (2006.01) |

(52) U.S. Cl.

CPC ..... *F21V 29/30* (2013.01); *F21K 9/135* (2013.01); *F21Y 2101/02* (2013.01); *F21V 31/04* (2013.01); *F21V 7/22* (2013.01); *F21V 15/01* (2013.01); *F21V 23/02* (2013.01); *F21V 29/248* (2013.01); *F21K 9/50* (2013.01); *F21V 3/005* (2013.01); *F21V 3/02* (2013.01); *F21V 3/0418* (2013.01); *F21V 3/0436* (2013.01); *F21V 3/0472* (2013.01)

(58) Field of Classification Search

CPC ..... H01L 33/00
USPC ..... 362/311.02, 311.03, 311.04, 311.05, 362/311.11; 313/498; 315/192

See application file for complete search history.

(56) References Cited

U.S. PATENT DOCUMENTS

| | | | | |
|---|---|---|---|---|
| 7,837,348 | B2 * | 11/2010 | Narendran et al. | 362/231 |
| 8,614,539 | B2 * | 12/2013 | Dai et al. | 313/112 |
| 8,616,727 | B2 * | 12/2013 | Hisayasu et al. | 362/249.02 |
| 8,764,225 | B2 * | 7/2014 | Narendran et al. | 362/231 |

FOREIGN PATENT DOCUMENTS

| | | | |
|---|---|---|---|
| JP | 2006026303 | * | 6/2003 |

* cited by examiner

*Primary Examiner* — Ali Alavi

(74) *Attorney, Agent, or Firm* — Davis & Bujold, P.L.L.C.; Michael J. Bujold

(57) ABSTRACT

Disclosed herein is a a light emitting diode lamp including: a base having a power terminal capable of being electrically connected to an external alternating current (AC) power source; a housing coupled to the base and formed in a hollow structure; a light emitting diode package installed in the housing; the power supply module supplying an external AC power to the light emitting diode package; and a transparent insulating heat radiation liquid configured to radiate a heat generated from the light emitting diode package and the power supply module by impregnating the light emitting diode package and the power supply module therein and filled in the housing having the hollow structure.

11 Claims, 3 Drawing Sheets

LIGHT EMITTING DIODE LAMP

BACKGROUND OF THE INVENTION

1. Technical Field

The present invention relates to a light emitting diode lamp capable of having excellent light emitting efficiency and being manufactured at a low cost.

2. Description of the Related Art

As an electric bulb capable of generating brightness similar to that of an existing incandescent lamp at a low power, a light emitting diode (LED) incandescent lamp has been spotlighted.

However, since the LED incandescent lamp used in various fields such as home illumination, office illumination, factory illumination, a streetlamp, a fishing lamp, scene illumination, illumination for leisure facilities is driven at a current and voltage different from those of the existing incandescent lamp, there is a problem that a power source facility including an electric bulb socket that has been already installed should be replaced. In addition, the LED incandescent lamp has a disadvantage in that it should effectively radiate a heat generated from an LED.

A heat generation problem in an LED lamp reduces a lifespan of a light emitting diode package itself, a lifespan of a power supply module supplying a power to the LED, and light emitting efficiency. Therefore, efforts to solve the heat radiation problem have been made.

Therefore, recently, in the LED lamp, a large-sized metal heat radiation plate has been attached to the LED lamp in order to radiate the heat of the LED and the power supply module. Further, in order to improve heat radiation efficiency, various forms and materials have been suggested.

However, in the case of a cooling scheme using the large-sized metal heat radiation plate, cooling efficiency is insufficient, and weight of the LED lamp itself is increased to decrease applicability of a product. In addition, since the large-sized metal heat radiation plate itself is expensive, it is difficult to commercialize the LED lamp.

SUMMARY OF THE INVENTION

An object of the present invention is to provide a light emitting diode lamp capable of increasing a lifespan of a light emitting diode (LED) itself and raising a commercial value of an LED lamp by being manufactured at a low cost and having high heat radiation efficiency.

According to an exemplary embodiment of the present invention, there is provided a light emitting diode lamp including: a base having a power terminal capable of being electrically connected to an external alternating current (AC) power source; a housing coupled to the base and formed in a hollow structure; a light emitting diode package installed in the housing; a support structure supporting the light emitting diode package and a power supply module; the power supply module supplying an external AC power to the light emitting diode package; and a transparent insulating heat radiation liquid configured to radiate a heat generated from the light emitting diode package and the power supply module by impregnating the light emitting diode package and the power supply module therein and filled in the housing having the hollow structure.

The transparent insulating heat radiation liquid may be a dimethyl silicon oil.

The housing may be made of a thermoplastic resin having a light diffusing agent.

A nano pattern diffusing a light may be formed on a surface of the housing.

The light emitting diode lamp may further include a lens attached to a front surface of the light emitting diode package to diffuse a light emitted from a light emitting diode (LED).

The light emitting diode lamp may further include a reflection plate attached to the base to reflect and diffuse a light emitted from the light emitting diode package.

The reflection plate may be produced by coating a metal on a molded plastic surface.

The reflection plate may have a protrusion part diffusing the light.

The housing may have a cylinder form.

The power supply module may include: an AC to direct current (DC) converter converting the AC power into a DC power; a rectifying circuit connected to the AC to DC converter; and a dimming circuit connected to the rectifying circuit to adjust a current of the rectified DC power.

DESCRIPTION OF THE PREFERRED EMBODIMENTS

Hereinafter, a light emitting diode (LED) lamp according to an exemplary embodiment of the present invention will be describe in more detail with reference to the accompanying drawings. In the following description, a bulb type LED lamp will be described by way of example. However, it is to be understood that the present invention is not limited thereto, but may also be applied to a cylinder type (fluorescent lamp type) LED lamp and a flat panel type lamp.

Figure 1:
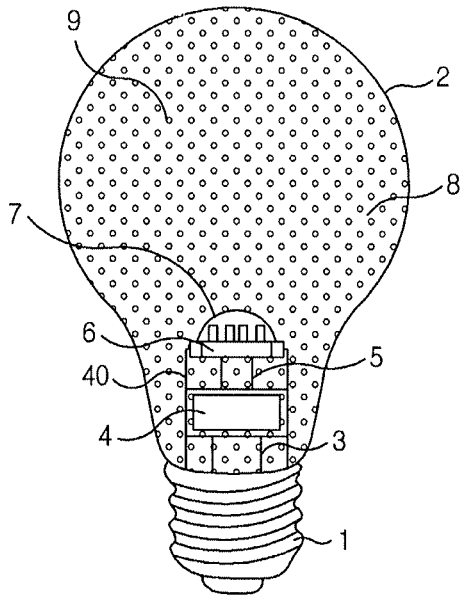
FIG. 1 is a perspective view showing a light emitting diode lamp according to an exemplary embodiment of the present invention.

FIG. 1 is a perspective view showing a light emitting diode lamp according to an exemplary embodiment of the present invention. In FIG. 1, a direct current (DC) type LED lamp is shown.

The LED lamp is configured to include a base 1, a housing 2, an alternating current (AC) power lead wire 3, a power supply module 4, a direct current (DC) power lead wire 5, a light emitting diode package 6, a lens 7, and a heat radiation liquid 9, as shown in FIG. 1.

The base 1 has a spiral protrusion structure capable of being coupled to a general incandescent lamp socket and includes a power source terminal capable of being electrically connected to an external AC power source. The base 1 is made of an electrical conductive metal.

The bulb type housing 2 is closed so that it may confine the heat radiation liquid 9 in a housing hollow 8 and is made of a glass or a plastic. The housing 2 made of the plastic has an advantage in that damage due to external impact may be minimized. According to an illumination property, light diffusing coating is performed on an inner or outer portion of the bulb type housing 2 or a light diffusing film is attached to the outer portion of the bulb type housing 2.

In addition, a nano pattern may also be formed on a surface of the housing 2 in order to diffuse a light. When the light diffusing film is attached to the bulb type housing 2, scattering of the glass at the time of external impact may be minimized.

As the AC power lead wire 3, which is a power wire supplying an AC power supplied from the outside of the light emitting diode lamp according to the exemplary embodiment of the present invention to the power supply module 4, an enameled copper wire is mainly used.

Figure 3:
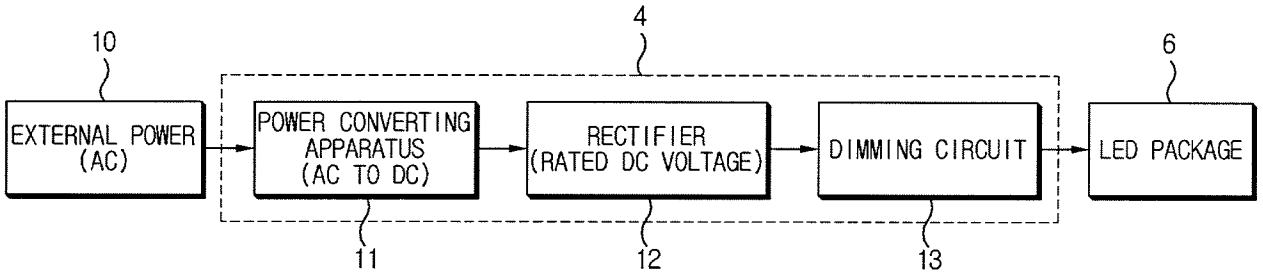
FIG. 3 is a block diagram showing a configuration of the light emitting diode lamp according to the exemplary embodiment of the present invention.

The power supply module 4, which is an apparatus converting the AC power supplied from the outside of the light emitting diode lamp into a DC power according to a property of the light emitting diode package 6 and then and supplying the DC power, includes an AC to DC converter 11, a rectifying circuit 12 supplying a constant DC voltage, and a dimming circuit 13 adjusting a current amount of the DC voltage to adjust brightness of the light, as shown in FIG. 3.

As the DC power lead wire 5, which is a power wire supplying the DC power supplied from the power supply module 4 to the light emitting diode package 6, an enameled copper wire is mainly used.

The light emitting diode package 6 may be a printed circuit board (PCB), a flexible printed circuit board (FPCB), a chip on board (COB) in which at least one light emitting diode is mounted according to the illumination property.

An LED used in the light emitting diode package 6 is a light emitting source. Although a white LED is mainly used, a red LED, a blue LED, and a green LED may be individually or a mixture thereof may be used, according to the illumination property.

The lens 7 is attached to a front surface of the light emitting diode package 6 and serves to collect or diffuse the light emitted from the light emitting diode package 6 according to the illumination property. The lens 7 is made of a plastic. In addition, an optical film is attached to, a light diffusing agent is coated, or a nano pattern is applied to a surface of the lens manufactured in order to diffuse the light.

A support structure 40 of FIG. 1 supports the light emitting diode package 6 and the power supply module 30. That is, the support structure 40 serves to prevent shaking of the light emitting diode package 6 and the power supply module 30.

The heat radiation liquid 9 serves to radiate a heat generated from the power supply module 4 and the light emitting diode package 6 to the outside of the housing 2 and emit the light emitted from the light emitting diode package 6 to the outside of the housing 2. Therefore, the heat radiation liquid 9 needs to have all of the heat radiation property, the light transmission property, and the electrical insulating property. Since the heat radiation liquid 9 may entirely contact directly the light emitting diode package 6 and the power supply module 4, it may radiate the heat from the entire surface of the light emitting diode package 6 and the power supply module 4, such that it has a more excellent heat radiation property and is manufactured at a low cost, as compared with an air cooling type metal heat radiation plate. As a result, in the case of using the heat radiation liquid 9, a lifespan of the LED is increased. Since the heat radiation liquid has both of the heat radiation property and the insulating property, even though the power supply module 4 driving the LED, the light emitting diode package 6, and the like, which have an electrical property are embedded in the housing hollow 8 filled with the heat radiation liquid 9, an electrical conduction phenomenon is not generated. In the present invention, a dimethyl silicone oil that is nontoxic and has an excellent electrical insulating property, an excellent light transmission property, and an excellent thermal conductivity is used as the heat radiation liquid. Particularly, since the dimethyl silicone oil has an excellent thermal stability to maintain the stability at a high temperature, even though a temperature of the light emitting diode package 6 rises, the dimethyl silicone oil may be stably operated.

Figure 2:
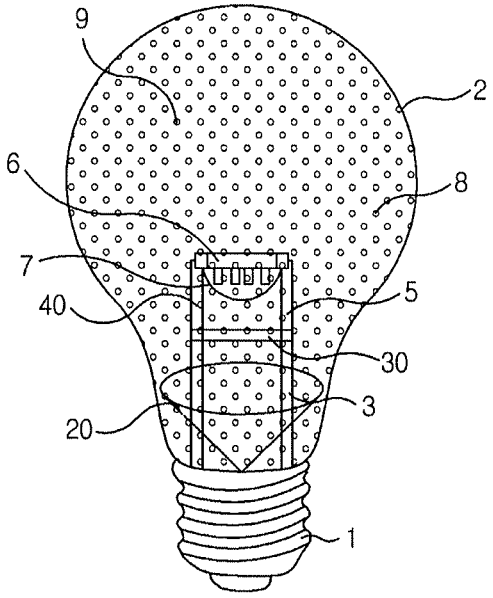
FIG. 2 is a perspective view showing a light emitting diode lamp according to another exemplary embodiment of the present invention.

FIG. 2 is a perspective view showing a light emitting diode lamp according to another exemplary embodiment of the present invention. In FIG. 2, an AC type LED lamp is shown. The AC type LED lamp is configured to include a base 1, a housing 2, an AC power wire 3, a power supply module 4, a power lead wire 5, a light emitting diode package 6, a lens 7, a heat radiation liquid 9, and a reflection plate 20, as shown in FIG. 2. A power supply module 40 of the AC type LED lamp shown in FIG. 2 is different from the power supply module 4 shown in FIG. 1 in that it allows the light emitting diode package to emit the light by changing voltage and current values rather than changing the external AC power into the DC power. Meanwhile, the base 1, the housing 2, the AC power line 3, the heat radiation liquid 8, or the like, has been described with reference to FIG. 1. Therefore, a description thereof will be omitted.

Meanwhile, the AC type LED lamp shown in FIG. 2 further includes the reflection plate 20. The reflection plate 20 is attached to the base and reflects the light emitted from the light emitting diode package 4 to supply the light to a wider place. The reflection plate 20 is produced by coating a metal on a molded plastic surface. The reflection plate 20 further includes a protrusion part diffusing the light to enhance a light diffusion effect. It is to be understood that the case in which the reflection plate is attached to the base may also be applied to the DC type light emitting diode lamp as shown in FIG. 1.

A support structure of FIG. 2 supports the AC light emitting diode package, the power supply module, and the reflection plate. That is, the support structure serves to prevent shaking of the AC light emitting diode package, the power supply module, and the reflection plate.

According to the exemplary embodiment of the present invention, the heat radiation liquid that may effectively radiate the heat generated from the light emitting diode package and the power supply module driving the LED without using the heat radiation plate and has an excellent insulating property and an excellent heat radiation function is used, thereby making it possible to reduce a manufacturing cost of the LED lamp and extend a lifespan of the LED lamp.

In addition, according to the exemplary embodiment of the present invention, the dimethyl silicone oil that has high thermal conductivity, high transparency, and high thermal stability and is economic is used as the heat radiation liquid, making it possible to secure economic efficiency and durability of the LED lamp.

In the LED lamp as described above, the configuration and the method of the above-mentioned exemplary embodiments are not restrictively applied. That is, all or some of the respective exemplary embodiments may be selectively combined with each other so that they may be various modified.

What is claimed is:

1. A light emitting diode lamp comprising:

a base having a power terminal capable of being electrically connected to an external alternating current (AC) power source;

a housing coupled to the base and forming a hollow structure;

a light emitting diode package installed within the hollow structure of the housing;

a support structure supporting the light emitting diode package and a power supply module;

the power supply module supplying an external alternating current (AC) power to the light emitting diode package; and a transparent insulating heat radiation liquid filling the hollow structure of the housing so that both the light emitting diode package and the power supply module are impregnated within the transparent insulating heat radiation liquid, and the transparent insulating heat radiation liquid, during operation of the light emitting diode lamp, radiating heat generated from both the light emitting diode package and the power supply module.

2. The light emitting diode lamp of claim 1, wherein the transparent insulating heat radiation liquid is a dimethyl silicon oil.

3. The light emitting diode lamp of claim 1, wherein the housing is made of a thermoplastic resin which has a light diffusing agent.

4. The light emitting diode lamp of claim 1, wherein a nano pattern diffusing a light is formed on a surface of the housing.

5. The light emitting diode lamp of claim 1, further comprising a lens attached to a front surface of the light emitting diode package for diffusing light emitted from a light emitting diode (LED) of the light emitting diode lamp.

6. The light emitting diode lamp of claim 1, further comprising a reflection plate attached to the base for reflecting and diffusing light emitted from the light emitting diode package.

7. The light emitting diode lamp of claim 6, wherein the reflection plate is produced by coating a metal on a molded plastic surface.

8. The light emitting diode lamp of claim 6, wherein the reflection plate has a protrusion part diffusing the light.

9. The light emitting diode lamp of claim 1, wherein the housing has a bulb form.

10. The light emitting diode lamp of claim 1, wherein the housing has a cylinder form.

11. The light emitting diode lamp of claim 1, wherein the power supply module includes:

an alternating current (AC) to direct current (DC) converter for converting the alternating current (AC) power into direct current (DC) power;

a rectifying circuit connected to the alternating current (AC) to the direct current (DC) converter; and a dimming circuit connected to the rectifying circuit to adjust a current of the rectified direct current (DC) power.

* * * * *